United States Patent [19]

Martin, Sr.

[11] Patent Number: 5,062,280

[45] Date of Patent: Nov. 5, 1991

[54] AIR CONDITIONING APPARATUS

[76] Inventor: Lendell Martin, Sr., 7037 Brittmore, Houston, Tex. 77041

[21] Appl. No.: 606,896

[22] Filed: Oct. 31, 1990

[51] Int. Cl.[5] ..... F25D 21/14

[52] U.S. Cl. ..... 62/291; 165/126; 237/53

[58] Field of Search ..... 165/126, 124; 237/50, 237/53; 62/291

[56] References Cited

U.S. PATENT DOCUMENTS

| | | | |
|---|---|---|---|
| 1,819,608 | 8/1931 | Lewis | 165/124 X |
| 1,863,554 | 6/1932 | Alberts | 165/126 |
| 2,022,523 | 11/1935 | Roessler | 257/9 |
| 2,169,109 | 8/1939 | Muller | 165/126 X |
| 2,277,870 | 3/1942 | Meyerhoefer | 165/126 X |
| 2,884,228 | 4/1959 | Jorgensen | 165/126 X |
| 2,995,906 | 8/1961 | Brandimarte | 165/124 X |
| 3,372,870 | 3/1968 | Norris et al. | 236/13 |
| 3,405,758 | 10/1968 | Walker et al. | 165/16 |
| 3,411,569 | 11/1968 | Hildreth | 165/63 |
| 3,464,487 | 9/1969 | Gold et al. | 165/16 |
| 3,540,526 | 11/1970 | Hoaglund | 165/22 |
| 3,596,475 | 8/1971 | Berger | 62/291 X |
| 3,625,022 | 12/1971 | Johnson | 62/159 |
| 4,657,178 | 4/1987 | Meckler | 236/13 |

OTHER PUBLICATIONS

"Ruud Electric Furnaces UE(*)B-Series," Ruud Air Conditioning Division, 6/1988.

"Model 519E," Payne Air Conditioning, 9/1990.

"Rudd Indoor Coils", Ruud Air Conditioning Division, 5/1989.

*Primary Examiner*—William E. Tapolcai

*Attorney, Agent, or Firm*—Guy McClung

[57] ABSTRACT

Air conditioning apparatus with an enclosure which both houses a conditioning coil and serves as a plenum for transferring air to one or more conduits. In one aspect, vanes of the coil or coils are oriented to direct air toward openings in the plenum. An enclosure that serves as a coil housing and as a plenum.

4 Claims, 2 Drawing Sheets

AIR CONDITIONING APPARATUS

BACKGROUND OF THE INVENTION

1. Field of the Invention

This invention is related to air conditioning apparatuses, e.g. for heating or cooling air, and, in one aspect to such apparatuses with a coil in a plenum box.

2. Description of Related Art

In various prior art air conditioning systems the blower of a furnace is used to propel air through a transition member connected to the furnace, through a coil, and into a plenum box. Through various openings in the plenum box air exits into conduits which carry it to various locations.

These prior art systems are relatively complex since they require a transition member and also the various connections between the transition member and the coil housing and between the coil housing and the plenum box. These systems are inefficient since the air moves from the coil in one direction, hits the interior of the plenum box, changes direction, and then exits, often after multiple encounters with the plenum's interior. The dimensions of the transition member and the dimensions of the connecting members often depend on the size of the coil that is used; so that even if several locations have an identical blower, different transition members, etc. may be required.

In accordance with 37 C.F.R. §156, the following are disclosed:

"Ruud ElectricFurnaces," Ruud Air Conditioning Division, 1988.

"Cased Horizontal Furnace Coils Model 519E," Payne Air Conditioning, April, 1990.

"Ruud Indoor Coils," Ruud Air Conditioning Division, 1989.

U.S. Pat. No. 2,022,523 discloses an air conditioning apparatus with a blower in an enclosure and a U-shaped duct with a discharge opening. Both heat exchange elements and cooling coils are disposed in the U-shaped duct.

U.S. Pat. No. 3,372,870 discloses an air treating assembly which includes a condensing unit, exhaust and air intake assembly, a filter, a blower assembly, a heater, a cooling coil and a mixing damper assembly.

U.S. Pat. No. 3,405,758 discloses an air mixing apparatus for controlling air flow in a duct, having blowers that blow air through a heating unit and through a cooling unit.

U.S. Pat. No. 3,411,569 discloses a combined heating-cooling unit.

U.S. Pat. No. 3,464,487 discloses an air handling unit with a housing enclosing blowers, a heating element, and a cooling element.

U.S Pat. No. 3,540,526 discloses a rooftop air conditioning unit having a blower and evaporator coil through which air is blown and then flows out from a housing outlet.

U.S Pat. No. 3,625,022 discloses an air conditioning unit with a blower and coils. Conditioned air is exhausted into a chamber from which air-conveying conduits extend U.S. Pat. No. 4,657,178 discloses an air mixing box for transferring conditioned air.

There has long been a need for an efficient air conditioning apparatus which utilizes the blower of a gas or electric furnace. There has long been a need for such an apparatus which is simple, easily made, easily installed, and easily accessed. There has long been a need for such an apparatus which efficiently moves cooled air (or heated air) from a plenum box. There has long been a need for such an apparatus that can efficiently accommodate different size, shape, and type coils.

SUMMARY OF THE PRESENT INVENTION

The present invention, in one embodiment, includes an enclosure with an opening for intercommunicating with a blower of a furnace. The blower is used in air conditioning during hotter periods when the furnace is shut off or it is used (e.g. in conjunction with a heat pump) to produce heated air. The enclosure serves as a plenum to which one or more air-carrying conduits are connected and as a housing for a coil or coils (e.g. cooling coils or heating coils). In this way the need for a transition member between the furnace and a coil housing is eliminated and the need for connection of a coil housing to a plenum is also eliminated.

In one embodiment, the enclosure according to the present invention houses a coil with coil vanes disposed so that air passing through them is directed generally toward openings in the enclosure to which are connected the air-carrying conduits. In this way, the air flows more directly into the conduits rather than contacting the plenum's interior before finally exiting from it.

By using the enclosure as a plenum box and as the housing for the coil, a variety of different size, shape, and configuration coils can be used in one enclosure. Thus, for buildings with identical furnaces, but different air conditioning loads, the same enclosure may be employed for coils of different capacity or type. In this way, the need for separate and distinct transition members for plenums and each type of coil is eliminated.

The enclosure itself may have one side for interconnecting with the furnace housing, which side is fashioned so that it can accommodate a variety of furnace housing openings.

It is, therefore, an object of the present invention to provide new, useful, unique, efficient and nonobvious apparatuses for air conditioning (e.g. cooling or heating).

A further object of the present invention is the provision of new, useful, unique, and nonobvious apparatuses and methods for efficiently moving conditioned air to the outside of an apparatus.

Another object of the present invention is the provision of such apparatuses which can be used with a furnace blower without requiring separate transition members and plenums for each different type of air conditioning cooling coil.

Yet another object of this invention is the provision of such apparatuses in which air is moved efficiently with a minimum of flow obstruction and with a minimum of encounters with the interior of a plenum.

An additional object of the present invention is the provision of such apparatuses which can accommodate a variety of furnaces.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

DESCRIPTION OF EMBODIMENTS PREFERRED AT THE TIME OF FILING FOR THIS PATENT

Figure 1:
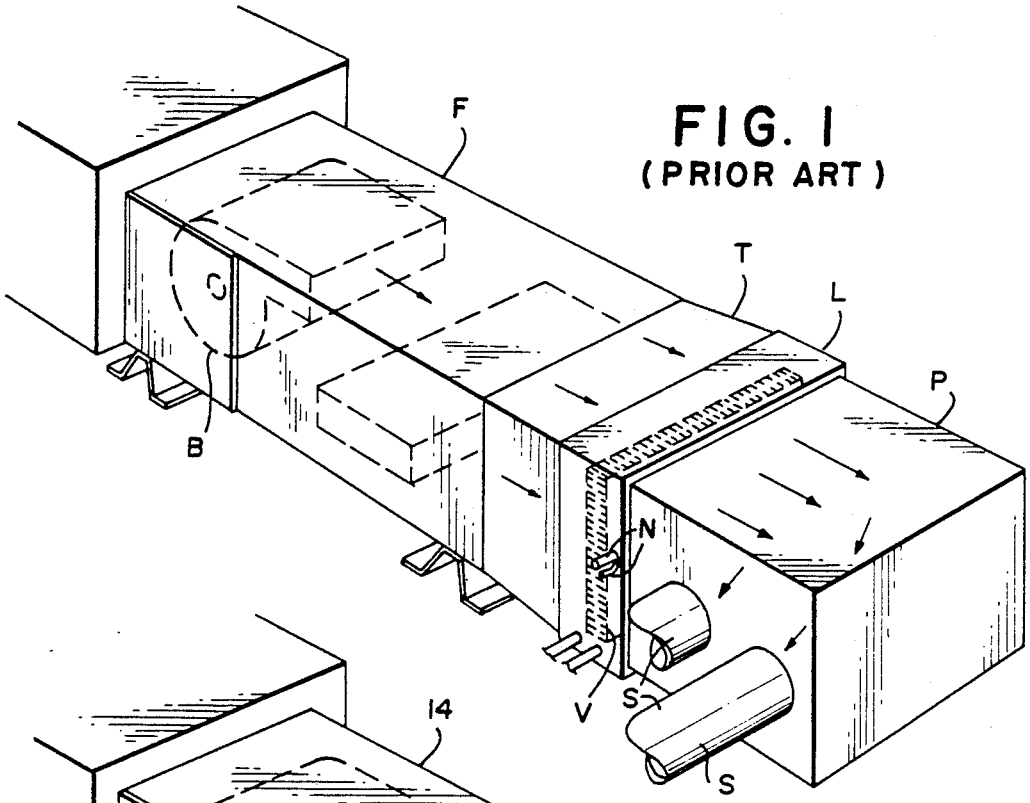
FIG. 1 (PRIOR ART)
FIG. 1 is a schematic view of a prior art air conditioning apparatus.

Referring now to FIG. 1 a typical prior art apparatus is shown schematically. A blower B in a furnace housing F propels air into a transition member T which is interconnected between the housing F and a housing L of an air conditioning coil C. The air moves through the vanes V of the coil C, exiting the housing L and moving into a plenum box P. Some of the air (as shown by the arrows) encounters the interior walls of the plenum P. Air exits the plenum P into various conduits S which carry the conditioned air to locations as desired. Cooling fluid flows through connections N of the coil C.

Figure 2:
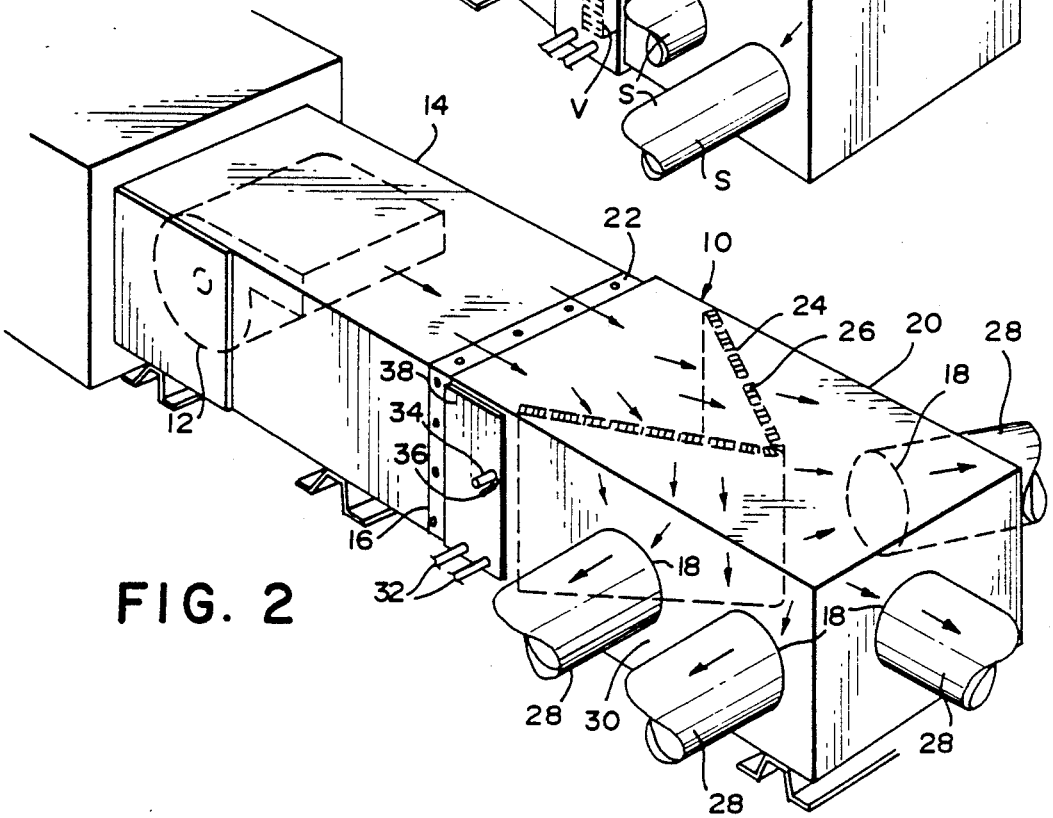
FIG. 2 is a schematic view of an air conditioning apparatus according to the present invention.

As shown in FIG. 2, an apparatus 10 according to the present invention includes a blower 12 of a furnace in a furnace housing 4. The furnace housing 14 has an opening 16 which communicates with an enclosure 20 via a connection member 22. A coil 24 is disposed in the enclosure 20. A service door 38 permits access to the interior of the enclosure 20.

Air is moved by the blower 12 from the furnace housing 14 and then through vanes 26 of the coil 24. The coil can be a cooling coil that cools the air (or a heating coil for heating the air if no furnace element is present or if it is desired to augment the heating of a furnace element that is present). The cooled air flows from the coil into the interior of the enclosure 20 and then into conduits 28 connected to openings 18 in the enclosure 20. As shown, the vanes 26 are oriented so that some of the air moving between them is redirected in the direction of the openings 18. A pan 30 is disposed beneath the coil 24 and liquid drains from the pan out of drain nipples 32.

Figure 3:
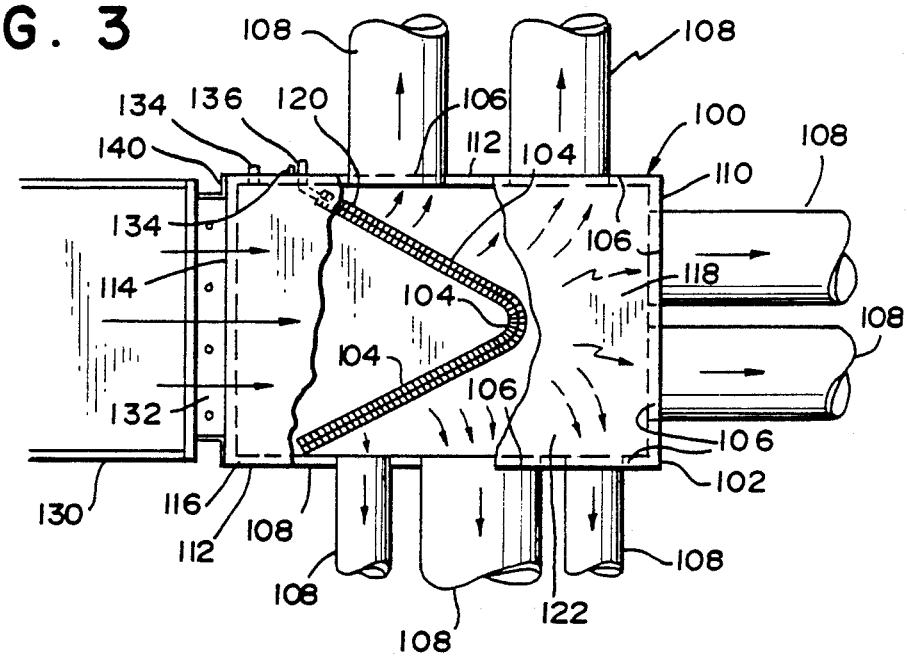
FIG. 3 is a top view of an apparatus according to the present invention.

Referring now to FIG. 3, an apparatus 100 according to the present invention has an enclosure 102 including a top wall (not shown), a bottom wall 106 and side walls 110, 112, 114 and 116. A coil 120 is mounted within the enclosure 102 and a drip pan 122 is disposed in the enclosure beneath the coil 120.

Each side wall is made with metal bracing (see FIG. 4) to which is connected an insulating material such as duct board. Holes can be cut in the duct board as desired to provide openings leading to air-carrying conduits. Cooling fluid flows through connections 136 on the coil 120. According to this invention, it is preferred that coils are used with Vanes oriented to project air from the coils in the direction of air-carrying conduit openings for greater air conveying efficiency. Vanes 104 of the coil 120 are oriented so that air leaving the coil is heading toward openings 106 to which are connected various ducts 108. A pan 118 extends over the entire bottom of the enclosure 102. This is useful when coils of different size or configuration are to be installed in one enclosure. Liquid drains from the pan 118 out through drain nipples 134. By providing a pan that covers the entire piece of duct board that forms the bottom wall of the enclosure, dripping from any size coil is caught and transferred out from the enclosure. An enclosure according to this invention may house different coils (although an enclosure would not usually have multiple coils; but this is not beyond the scope of this invention). For example, two V-shaped coils may be used, on adjacent to the other.

A connection member 140 connected to the side wall 14 provides a convenient interface for the apparatus 100 and a furnace blower housing 130. The connection member 140 is made from metal bracing 132 and is easily affixed to the bracing of the wall 114 with sheet metal screws.

Figure 4:
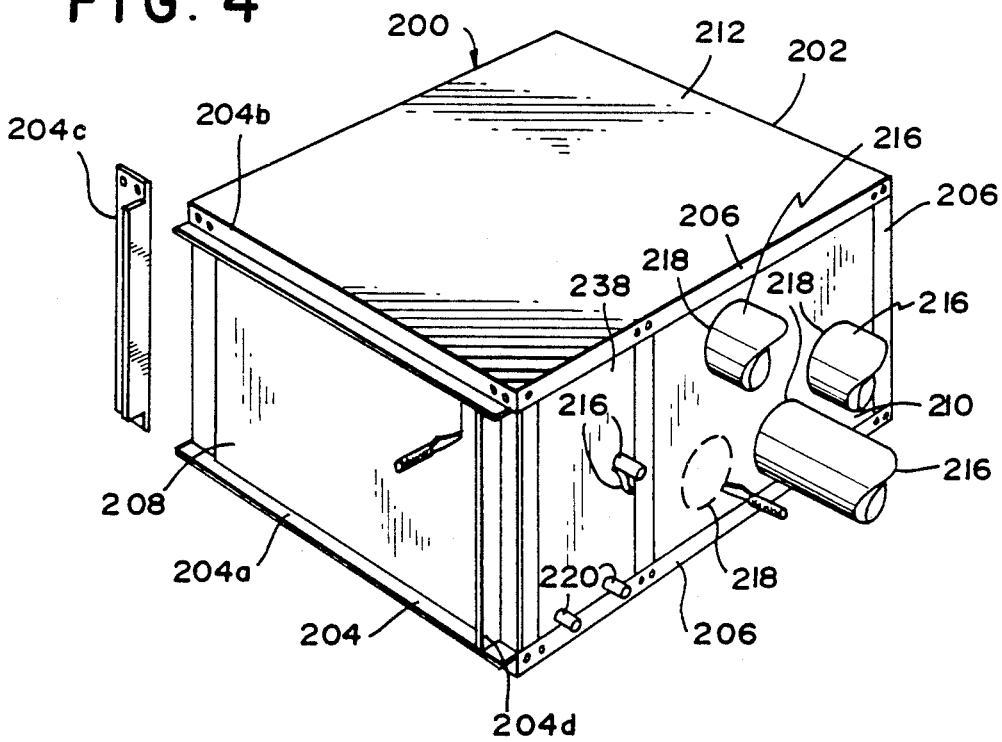
FIG. 4 is a perspective view of an apparatus according to the present invention.

Referring now to FIG. 4, an apparatus 200 according to the present invention has an enclosure 202 (like the enclosure 102 of FIG. 3). FIG. 4 illustrates how an enclosure 202 according to this invention may have a connection member 204 (like members 22, FIG. 2 and 140, FIG. 3) sized to accommodate an opening in a blower or furnace housing. The connection member 204 includes four pieces of metal bracing **204*a*, 204*b*, 204*c*, and 204*d*. The pieces 204*c* and 204*d* may be positioned as desired to mate with another housing's opening. Also, the pieces 204*a* and 204*b* could be moved to accommodate such an opening. The pieces are secured to bracing 206 which forms a cubic skeleton for the enclosure 202, e.g. with metal screws. For ease of construction, an opening of appropriate size is cut in a side wall 208 of the enclosure 202 before the pieces of the connection member 204 are installed. It is preferred that sidewalls, e.g. walls 208 and 210, and the other walls be made from an insulative material such as duct board and that a metal top 212 cover the top duct board wall. A drain pan, not shown, within the enclosure 202 sits on top of a bottom duct board wall and liquid drains out through drain nipples 220. By using duct board, holes 218 can easily be cut as desired for connecting air-conveying conduits 216 to the enclosure 202. Service door 238 is like service door 38, FIG. 1 connections 136 are like connection 136, FIG. 3. The bottom duct board wall, not shown, has an underlaying metal bottom, not shown, like the metal top 212**.

In conclusion, therefore, it is seen that the present invention and the embodiments disclosed herein are well adapted to carry out the objectives and obtain the ends set forth at the outset. Certain changes can be made in the method and apparatus without departing from the spirit and the scope of this invention. It is realized that changes are possible and it is further intended that each element or step recited in any of the following claims is to be understood as referring to all equivalent elements or steps for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as other inherent therein.

What is claimed is:

1. A device for conditioning air, the device comprising an enclosure having an interior, an air conditioning coil with a plurality of vanes disposed in the enclosure, a first opening in the enclosure through which unconditioned air flows to the coil, at least one second opening in the enclosure to which flows air conditioned by the coil and from which air flows to an air-conveying means for conveying conditioned air from the enclosure, the coil's vanes directing air in the general direction of the at least one second opening, the at least one second opening comprising a plurality of second openings and the vanes direct air in the general direction of at least two of the plurality of second openings, a blower for moving unconditioned air to the coil, and the blower mounted in a housing having an outlet in communication with the first opening.

2. A device for conditioning air, the device comprising an enclosure having an interior, an air conditioning coil with a plurality of vanes disposed in the enclosure, a first opening in the enclosure through which unconditioned air flows to the coil, at least one second opening in the enclosure to which flows air conditioned by the coil and from which air flows to an air-conveying means for conveying conditioned air from the enclosure.

the coil's vanes directing air in the general direction of the at least one second opening, a connection member for connecting the device to an outlet of an air-conveying apparatus, the connection members comprising movable members for accommodating outlets of different size, connections extending from the coil through which conditioning fluid flows, the connections extending through a service door movably connected to the enclosure for providing access to this interior, a drain pan disposed beneath the coil, the drain pan having means for transferring drained liquid therefrom, the means for transferring drained liquid is at least one drain nipple, the drain nipple extending through the service door, the enclosure is generally cubical having four side walls and a top wall and a bottom wall, the coil V-shaped with the point of the V pointing away from a first sidewall and toward another sidewall, each of the side walls other than the first sidewall having at least one opening therein from which air exits the enclosure, and the vanes directing air conditioned by the coil in the general direction of each sidewall other than the first sidewall, and the enclosure comprised of an insulative material with a top and bottom over the insulative material made from metal.

3. The device of claim 2 including also a blower for moving unconditioned air to the coil, the blower mounted in a housing having an outlet in communication with the first opening.

4. A device for conditioning air, the device comprising a generally cubical enclosure having an interior, four side walls, a top wall, and a bottom wall, a V-shaped air conditioning coil with a plurality of vanes disposed in the enclosure, the coil having a point of the V-shape pointing away from a first sidewall and toward another of the sidewalls, a first opening in the enclosure through which unconditioned air flows to the coil, each of the side walls other than the first sidewall having at least one opening therein from which air exits the enclosure, and the coil having vanes which direct air conditioned by the coil in the general direction of each sidewall other than the first sidewall.

* * * * *

US005062280B1

REEXAMINATION CERTIFICATE (3954th)

United States Patent [19] [11] B1 5,062,280

Martin, Sr. [45] Certificate Issued Dec. 14, 1999

[54] AIR CONDITIONING APPARATUS

[75] Inventor: Lendell Martin, Sr., Houston, Tex.

[73] Assignee: Allstyle Coil Co., Inc., Houston, Tex.

Reexamination Request:
No. 90/005,255, Feb. 9, 1999

Reexamination Certificate for:

| | |
|---|---|
| Patent No.: | **5,062,280** |
| Issued: | **Nov. 5, 1991** |
| Appl. No.: | **07/606,896** |
| Filed: | **Oct. 31, 1990** |

[51] Int. Cl.[6] ..... F25D 21/14
[52] U.S. Cl. ..... 62/291; 165/126; 237/53
[58] Field of Search ..... 62/291; 237/53, 237/50; 165/124, 126

[56] References Cited

U.S. PATENT DOCUMENTS 3,212,288 10/1965 Herbert ..... 62/290
3,831,670 8/1974 Mullings ..... 165/124

OTHER PUBLICATIONS

Installation Manual, Heat Controller, Inc., pp. 2–11, 1989.

Heating and Cooling, Time Life Books, pp. 108, 109, 112, and 118, 1977.

Home Guide to Plumbing, Heating, Air Conditioning, George Daniels, p. 131, 1967.

Installation and Operating Instructions, ICP Corporation, pp. 2–8, 1988.

*Primary Examiner*—William E. Tapolcai

[57] ABSTRACT

Air conditioning apparatus with an enclosure which both houses a conditioning coil and serves as a plenum for transferring air to one or more conduits. In one aspect, vanes of the coil or coils are oriented to direct air toward openings in the plenum. An enclosure that serves as a coil housing and as a plenum.

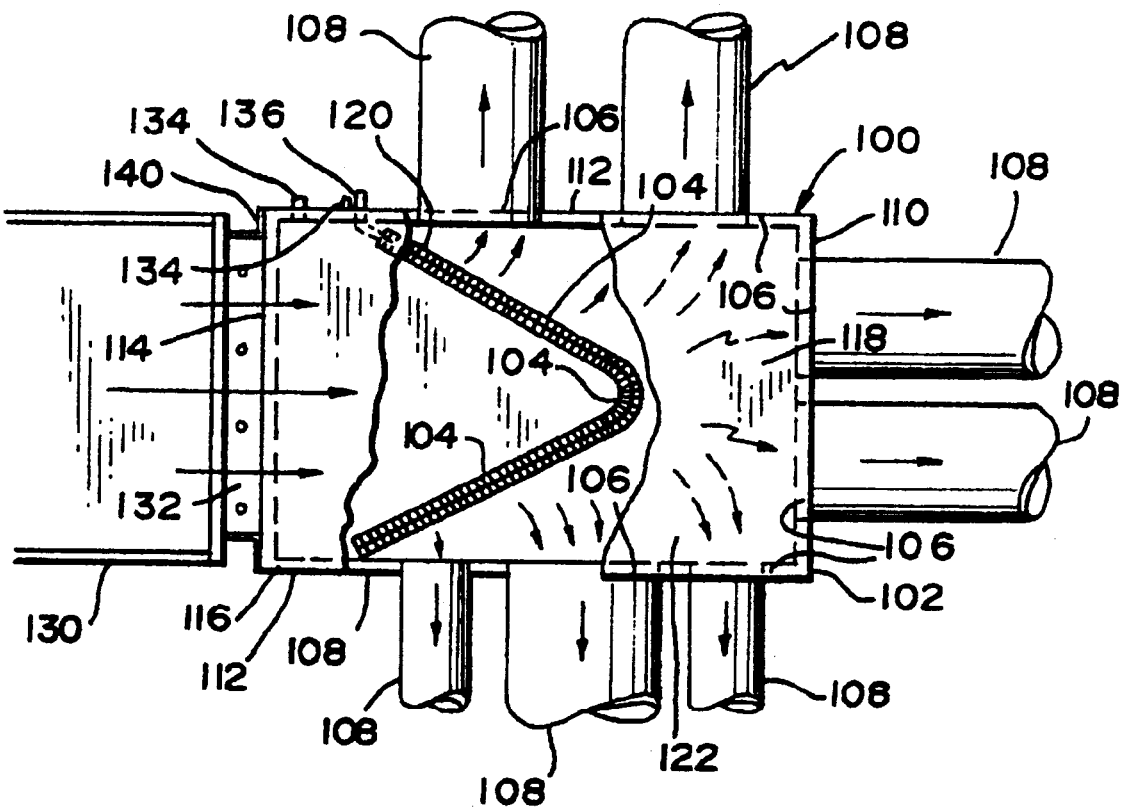

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–4 is confirmed.

* * * * *